US012384604B1

(12) United States Patent
Baldini

(10) Patent No.: US 12,384,604 B1
(45) Date of Patent: Aug. 12, 2025

(54) SECONDARY DISPENSING SYSTEM FOR A RIGID CONTAINER OF A FLOWABLE SUBSTANCE

(71) Applicant: Armando Baldini, Sunny Isles, FL (US)

(72) Inventor: Armando Baldini, Sunny Isles, FL (US)

( * ) Notice: Subject to any disclaimer, the term of this patent is extended or adjusted under 35 U.S.C. 154(b) by 0 days.

(21) Appl. No.: 19/211,850

(22) Filed: May 19, 2025

(51) Int. Cl.
*B65D 43/16* (2006.01)

(52) U.S. Cl.
CPC ..... *B65D 43/16* (2013.01); *B65D 2231/005* (2013.01); *B65D 2251/205* (2013.01)

(58) Field of Classification Search
CPC ..... B65D 2231/00; B65D 2231/005; B65D 43/14; B65D 43/16; B65D 43/161; B65D 43/162; B65D 43/163; B65D 43/164; B65D 43/165; B65D 43/166; B65D 43/167; B65D 43/168; B65D 43/18; B65D 1/06; B65D 23/04; B65D 47/08; B65D 47/0857; B65D 47/0861
See application file for complete search history.

(56) References Cited

U.S. PATENT DOCUMENTS 5,033,655 A * 7/1991 Brown ..... B29C 66/542 285/423
5,141,136 A * 8/1992 Tignor ..... B65D 1/06 215/381
5,421,488 A * 6/1995 Ehrbar ..... B65D 1/32 215/2
5,482,172 A * 1/1996 Braddock ..... B65D 1/06 220/837
2006/0243756 A1* 11/2006 Kawakita ..... B65D 51/1683 222/185.1

* cited by examiner

*Primary Examiner* — Javier A Pagan
(74) *Attorney, Agent, or Firm* — Ruben Alcoba, Esq.

(57) ABSTRACT

A secondary dispensing system for a rigid container of a flowable substance for improved dispensing capability is disclosed, which comprises a flanged aperture positioned along the outer perimeter of the base of the container, a surface panel configured to rest on the external surfaces of the container, a hinge that enables articulated rotational movement of the surface panel, and a headed pin affixed to the surface panel and configured to insert into and seal the flanged aperture. In the closed position of the system, the headed pin seals the flanged aperture. In its open position, the headed pin is disengaged to allow gravity-based dispensing of the totality of the residual flowable substance without requiring tapering of the container's internal surfaces. The system integrates with the container without materially modifying its design. The flowable substance may be a liquid, gel, mixture, or granular material.

4 Claims, 2 Drawing Sheets

SECONDARY DISPENSING SYSTEM FOR A RIGID CONTAINER OF A FLOWABLE SUBSTANCE

BACKGROUND

The present invention is directed to a secondary dispensing system for rigid containers that hold flowable substances, aimed at improving the dispensing capability of such containers. Typically, containers used for storing liquids, gels, mixtures, or granular materials are equipped with primary dispensing systems, such as caps or valves. However, these systems often do not allow for the complete and efficient dispensing of the residual substance remaining inside the container.

Conventional containers often suffer from the limitation of being difficult to fully empty, leaving behind significant amounts of the stored substance, especially when the internal surfaces of the container are not tapered or otherwise designed to facilitate complete evacuation. Additionally, primary dispensing systems are frequently ineffective in ensuring that all of the material can be dispensed, particularly in the case of viscous liquids or materials with a high tendency to cling to container walls.

In an attempt to address these challenges, several secondary dispensing systems have been proposed in the art. These systems generally involve mechanisms for further enhancing the dispensing capability beyond the primary system. However, known secondary dispensing systems may involve complex mechanisms and components such as collapsible inserts or inflatable bladders, be difficult to use, or require significant modifications to the original container design involving, for example, the complete redesign of its base to make it detachable, which can complicate manufacturing, increase costs, and potentially reduce consumer convenience.

The secondary dispensing system of the present invention overcomes these drawbacks by providing a simple, reliable, and efficient solution that integrates with the rigid container without materially altering its design. The system allows for the complete gravity-based dispensing of the flowable substance, ensuring that all residual material is evacuated from the container. This is achieved by a hinged surface panel that includes a base segment and wingwall, as well as a headed pin that seals a flanged aperture. The system allows the user to easily open and close the dispensing mechanism, with minimal effort and without requiring tapering of the container's internal surfaces.

SUMMARY

The present invention relates to a secondary dispensing system for a rigid container of a flowable substance, designed to provide improved dispensing capability by facilitating the complete emptying of the container's contents. The system is particularly suited for liquids, gels, mixtures, or granular materials and is configured to integrate with the rigid container without requiring significant modifications to its original design.

The secondary dispensing system comprises a flanged aperture located along the outer perimeter of the base of the rigid container. A surface panel, which includes a base segment and a wingwall, aligns with the external surfaces of the container. The base segment rests on the external surface of the base of the container whereas the wingwall rests on the external surface of the sidewall of the container. The surface panel is secured via a hinge, enabling articulated rotational movement between an open and closed position.

A headed pin with a shaft and head is attached to the surface panel. In the closed position, the headed pin is inserted into the flanged aperture, effectively sealing it and preventing leakage. In the open position, the headed pin is removed, enabling gravity-based dispensing of the totality of the residual substance without the need to taper any internal surface of the rigid container. The system may include additional design features to enhance its functionality, such as the use of plastic materials, making the system lightweight, durable, and resistant to corrosion or chemical reactions.

By integrating this secondary dispensing system, the invention ensures efficient and clean emptying of the container's contents, addressing the limitations of primary dispensing systems (e.g., top lids) that often leave residual substance behind. This improved dispensing solution offers enhanced practicality and ease of use for rigid container products in a variety of industries such as food, cosmetics, pharmaceuticals, and industrial chemicals, among others.

The secondary dispensing system enables the consumer to dispense the totality of the content of a rigid container, including but not limited to oils and creams, when the primary dispensing system or top lid does not allow for complete dispensing. The residual content left behind by primary dispensing systems in rigid containers ranges from approximately 1% to 10%, depending on the product.

Overall, the invention aims to provide a secondary dispensing system for rigid containers of flowable substances that enables the complete and efficient emptying of the container's content.

BRIEF DESCRIPTION OF THE DRAWINGS

These and other features, aspects, and advantages of the present invention will become better understood with regards to the following description, appended claims, and drawings where:

DESCRIPTION

Figure 1:
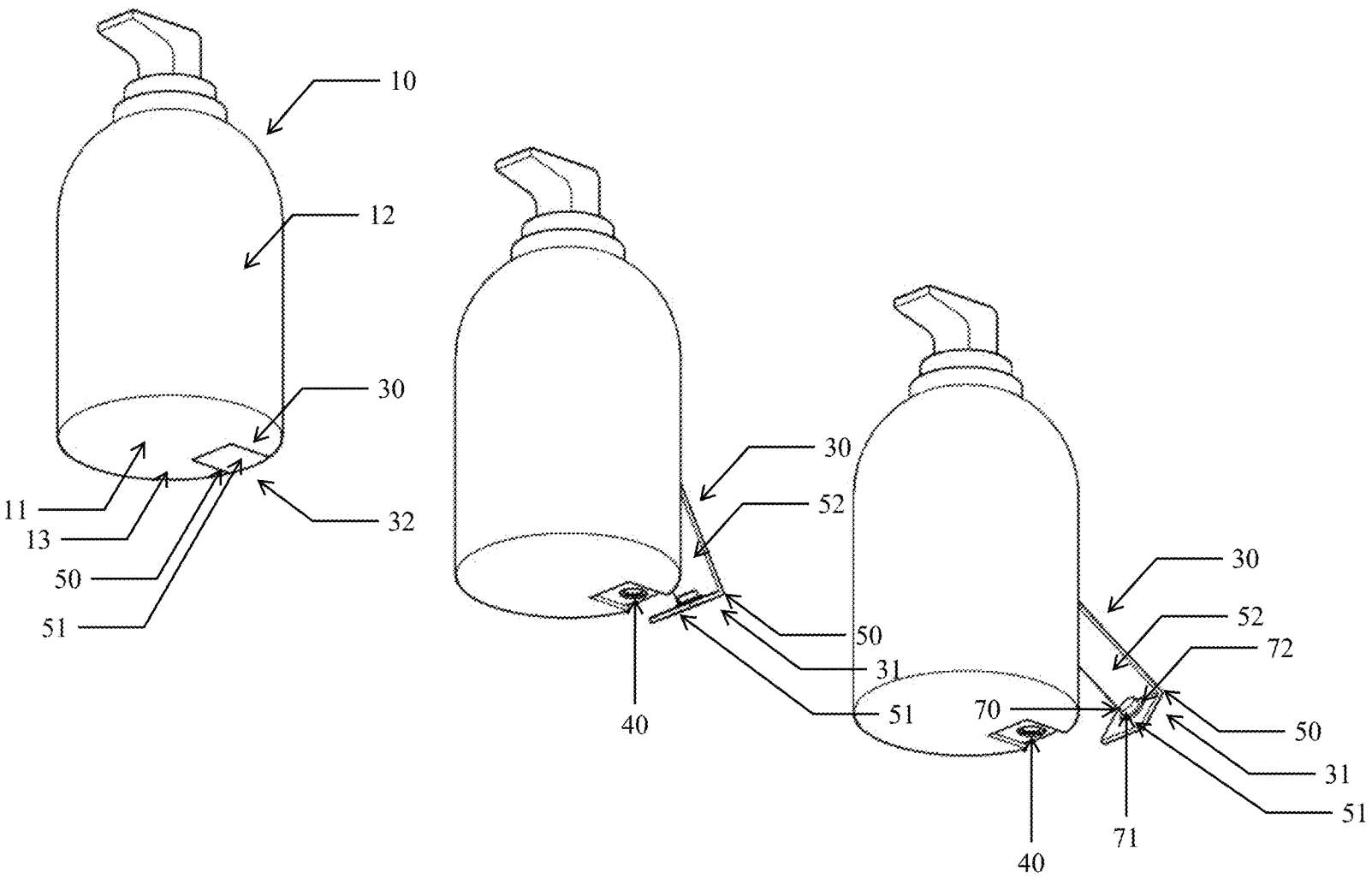
FIG. 1 is a series of sequential perspective views of the present invention from its closed position to its open position.
Figure 2:
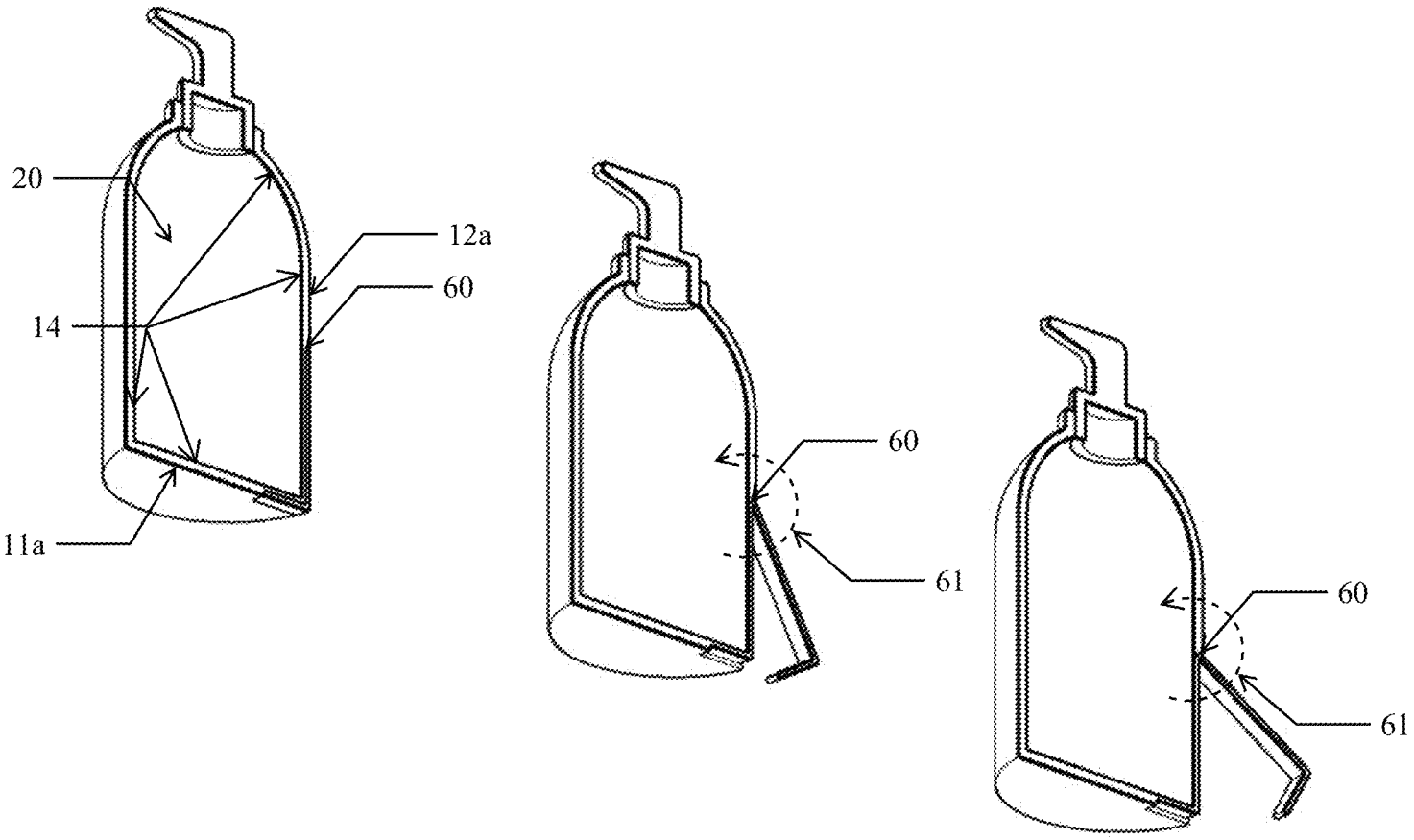
FIG. 2 is as series of sequential cross-sectioned perspective views of the present invention from its closed position to its open position.

As seen in FIGS. 1-2, the present invention is a secondary dispensing system 30 for a rigid container 10 of a flowable substance 20 for improved dispensing capability.

The secondary dispensing system 30 comprises a flanged aperture 40 located along an outer perimeter 13 of a base 11 of the rigid container 10. A surface panel 50 that defines a base segment 51 and a wingwall 52, the base segment 51 is configured to rest on an external surface 11*a* of the base 11 of the rigid container 10, the wingwall 52 is configured to rest on an external surface 12*a* of a sidewall 12 of the rigid container 10. A hinge 60 that secures the surface panel 50 to the external surface 12*a* of the sidewall 12 of the rigid container 10 and enables its articulated rotational movement 61. And, a headed pin 70 that defines a shaft 71 and a head 72, the shaft 71 is configured to insert into and seal the flanged aperture 40, the head 72 is fixedly attached to the base segment 51 of the surface panel 50. Wherein the secondary dispensing system 30 defines an open position 31 and a closed position 32 through the articulated rotational movement 61 of the surface panel 50. Wherein the headed pin 70 is removed from the flanged aperture 40 in the open position 31 of the secondary dispensing system 30, enabling gravity-based dispensing of the totality of the residual flowable substance 20 from the rigid container 10 without requiring tapering of any of its internal surfaces 14. Wherein the headed pin 70 is inserted into the flanged aperture 40 in the closed position 32 of the secondary dispensing system 30, effectively sealing the flanged aperture 40 and retaining the flowable substance 20 inside the rigid container 10 without leaks. Wherein the secondary dispensing system 30 is configured to integrate with the rigid container 10 without materially modifying its design. And, wherein the flowable substance 20 consists of either a liquid, gel, mixture, or granular material.

In an embodiment of the present invention, the rigid container 10 is made of a plastic.

In another embodiment of the present invention, the base segment 51 of the surface panel 50 is aligned with the external surface 11*a* of the base 11 of the rigid container 10 and the wingwall 52 of the surface panel 50 is aligned with the external surface 12*a* of the sidewall 12 of the rigid container 10.

In another embodiment of the present invention, the base segment 51 and wingwall 52 of the surface panel 50 are at about 90 degrees thus forming an L-shape.

An advantage of the present invention is that it increases the dispensing capability of the overall dispensing system of the rigid container. The strategic location of the flanged aperture along the outer perimeter of the base of the rigid container allows for gravity-based dispensing of the totality of the residual flowable substance, requiring, at most, slightly inclining the rigid container.

Another advantage of the present invention is that it virtually eliminates residual waste. The secondary dispensing system enables the total evacuation of the flowable substance, preventing waste that typically results from residue left at the bottom of rigid containers.

Another advantage of the present invention is its cost-effectiveness. Tapering of internal surfaces of the rigid container to assist with the complete dispensing of the totality of the residual flowable substance is not required, which significantly reduces the manufacturing cost associated with its implementation in standard rigid containers. Additionally, the secondary dispensing system has a minimal footprint to facilitate integration with standard rigid containers without requiring material modifications to their designs, that is, it avoids extensive redesigns and minimizes complexity, which significantly improves manufacturability. Moreover, all the components of the secondary dispensing system may be made of plastic, which further increases its cost-effectiveness.

Another advantage of the present invention is its compatibility. Its ability to integrate in standard rigid containers without material design modifications, facilitates retrofitting onto current products.

Another advantage of the present invention is its versatility. The secondary dispensing system is designed to dispense a variety of flowable substances including liquids, gels, mixtures and granular materials, which makes it suitable for multiple industries, such as food, cosmetics, pharmaceuticals and industrial chemicals, among others.

Another advantage of the present invention is its durability and reliability. The potential use of plastic as the selected material makes the secondary dispensing system lightweight, while also rendering it resistant to corrosion and chemical reactions.

Another advantage of the present invention is its enhanced operability. The hinged surface panel allows for articulated rotational movement, making it easy to open and close the secondary dispensing system with minimal effort.

Another advantage of the present invention is its ergonomic design. The base segment and wingwall of the surface panel may be aligned with the external surface of the rigid container. This ensures that no components of the secondary dispensing system project from the external surface of the rigid container, which results in compact and ergonomic design that greatly enhances consumer experience.

Another advantage of the present invention is its improved sealing performance. The flange around the perimeter of the aperture improves the leak resistance of the interface between the perimeter of the flanged aperture and the shaft of the headed pin when the secondary dispensing system is closed, ensuring that the rigid container remains sealed and keeping the flowable substance safe from spillage or contamination.

Still another advantage of the present invention is that it reduces user frustration by preventing the need to shake or invert the rigid container to access the residual content. It also provides a cleaner and more controlled dispensing process.

The embodiments of the secondary dispensing system for a rigid container of a flowable substance for improved dispensing capability herein are exemplary and numerous modifications, combinations, variations, and rearrangements can be readily envisioned to achieve an equivalent result, all of which are intended to be embraced within the scope of the appended claims. Further, nothing in the above-provided discussions of the secondary dispensing system for a rigid container of a flowable substance for improved dispensing capability should be construed as limiting the invention to an embodiment or a combination of embodiments. The scope of the invention is defined by the description, drawings, and claims.

What is claimed is:

1. A secondary dispensing system for a rigid container of a flowable substance for improved dispensing capability, the secondary dispensing system comprises:

a flanged aperture located along an outer perimeter of a base of the rigid container;

a surface panel that defines a base segment and a wingwall, the base segment is configured to rest on an external surface of the base of the rigid container, the wingwall is configured to rest on an external surface of a sidewall of the rigid container;

a hinge that secures the surface panel to the external surface of the sidewall of the rigid container and enables its articulated rotational movement; and a headed pin that defines a shaft and a head, the shaft is configured to insert into and seal the flanged aperture, the head is fixedly attached to the base segment of the surface panel, wherein the secondary dispensing system defines an open position and a closed position through the articulated rotational movement of the surface panel, wherein the headed pin is removed from the flanged aperture in the open position of the secondary dispensing system, enabling gravity-based dispensing of the totality of the residual flowable substance from the rigid container without requiring tapering of any of its internal surfaces, and wherein the headed pin is inserted into the flanged aperture in the closed position of the secondary dispensing system, effectively sealing the flanged aperture and retaining the flowable substance inside the rigid container without leaks, wherein the secondary dispensing system is configured to integrate with the rigid container without materially modifying its design, and wherein the flowable substance is either a liquid, gel, mixture, or granular material.

2. The secondary dispensing system for a rigid container of a flowable substance for improved dispensing capability of claim 1, wherein the rigid container is made of a plastic.

3. The secondary dispensing system for a rigid container of a flowable substance for improved dispensing capability of claim 1, wherein the base segment of the surface panel is aligned with the external surface of the base of the rigid container and the wingwall of the surface panel is aligned with the external surface of the sidewall of the rigid container.

4. The secondary dispensing system for a rigid container of a flowable substance for improved dispensing capability of claim 1, wherein the base segment and wingwall of the surface panel are at about 90 degrees.

* * * * *